US006623212B1

(12) United States Patent
Fonfrede et al.

(10) Patent No.: US 6,623,212 B1
(45) Date of Patent: Sep. 23, 2003

(54) CUT-OFF DEVICE FOR CONCRETE STRUCTURES

(76) Inventors: Dominique Fonfrede, 99, Impasse des Martinets, F-38920 Crolles (FR); Edmond Compassi, 110 rue de la Charve, Chambéry (FR)

( * ) Notice: Subject to any disclaimer, the term of this patent is extended or adjusted under 35 U.S.C. 154(b) by 0 days.

(21) Appl. No.: 09/857,019

(22) PCT Filed: Dec. 10, 1999

(86) PCT No.: PCT/FR99/03088

§ 371 (c)(1),
(2), (4) Date: May 31, 2001

(87) PCT Pub. No.: WO00/36228

PCT Pub. Date: Jun. 22, 2000

(30) Foreign Application Priority Data

Dec. 11, 1998 (FR) ..... 98 15848

(51) Int. Cl.[7] ..... E02D 13/08; E02D 7/12
(52) U.S. Cl. ..... 405/234; 102/302
(58) Field of Search ..... 405/234, 248–249, 405/239–240, 256–257; 102/302, 303

(56) References Cited

U.S. PATENT DOCUMENTS 3,432,977 A * 3/1969 Scholl ..... 405/234 X
3,496,729 A * 2/1970 Pleuger ..... 405/257
4,165,198 A * 8/1979 Farmer ..... 405/243
4,571,124 A 2/1986 Matsui et al.
4,673,157 A * 6/1987 Wells ..... 249/13
4,767,241 A * 8/1988 Wells ..... 405/239
5,622,453 A * 4/1997 Finley et al. ..... 405/240

FOREIGN PATENT DOCUMENTS

| | | |
|---|---|---|
| FR | 2 767 346 A1 | 2/1999 |
| JP | A 56-70324 | 6/1981 |
| JP | A 59-85023 | 5/1984 |
| JP | A 60-59223 | 4/1985 |

* cited by examiner

*Primary Examiner*—Heather Shackelford
*Assistant Examiner*—Sunil Singh
(74) *Attorney, Agent, or Firm*—Oliff & Berridge, PLC

(57) ABSTRACT

A cut-off element for concrete structures is formed by a plastic material flask having a flat-closed base and a tapering side envelope forming an acute angle with the base, said angle being between 25° and 60° for generating expansion forces so as to provoke a fracture of the concrete part along the cut-off zone defined by the base, and a lifting movement with slight amplitude of the concrete block after cut-off.

14 Claims, 4 Drawing Sheets

CUT-OFF DEVICE FOR CONCRETE STRUCTURES

BACKGROUND OF THE INVENTION

The invention relates to a device for cut-off or demolition of a concrete part, comprising means for inserting at least one cut-off element equipped with an elemental recipient designed to receive a reactive agent of chemical or mechanical nature to cause cracking of the concrete part by expansion effect.

START OF THE ART

A cut-off device using reentrant means placed in position before the concrete casting operation is performed to create a series of channels in the mass of hardened concrete has already been proposed. The reactive agent is then inserted in the channels communicating with the different recipients. Implementation of such a reentrant process makes use of a removable cage having a plurality of vertical rigid bars. The reaction of the expansion agent causes an explosion of the concrete mass, which requires the exploded concrete blocks to be dismantled.

OBJECT OF THE INVENTION

The object of the invention is to achieve a cut-off or demolition device of simple construction enabling the breaking zone of the part of a concrete structure to be demolished to be defined precisely, without affecting the mechanical strength of the rest of the structure.

The device according to the invention is characterized in that the recipient of each cut-off element is formed by a flask, made in particular of plastic material, having a flat closed base, and a lateral casing forming an acute angle with the base, said angle being comprised between 25° and 60° to generate expansion forces designed to cause fracturing of the concrete part along the breaking zone defined by the base, and a lifting movement of small amplitude of the concrete block after cut-off. The apex of the casing is fixed to a support means for placing the base at the required demolition level.

According to a preferred embodiment, the support means comprise a rigid tube joined to a tubular connecting spout arranged at the apex of the casing, said tube acting as inlet channel for insertion of the demolition agent into the flask.

Insertion of each cut-off element can be performed individually, or grouped by means of a positioning frame, before or after the concrete casting operation.

According to one feature of the invention, the positioning frame is fixed before the concrete casting operation to salient reinforcing bars by means of spacers spaced angularly between the different tubes of the cut-off elements. The spacers advantageously extend in the radial direction towards the inside of the positioning frame to confine an orifice for axial passage of the concrete casting pipe.

The flat base of the flask of each cut-off element is generally arranged horizontally and extending perpendicularly to the direction of insertion. This results in a horizontal fracture of the concrete along a plane passing through all the coplanar bases of the flasks. The block cut-off at the base then simply has to be lifted and the operation is finished.

It is also possible to obtain a diagonal fracture by using flasks with oblique bases arranged on the positioning frame in an inclined plane.

According to a development of the invention, each flask can be filled with a delayed-action expansive agent and is then placed in position before or after the concrete is cast, without making use of the filling tubes.

BRIEF DESCRIPTION OF THE DRAWINGS

Other advantages and features will become more clearly apparent from the following description of an embodiment of the invention given as a non-restrictive example only and illustrated in the accompanying drawings in which.

DESCRIPTION OF A PREFERRED EMBODIMENT

Figure 1:
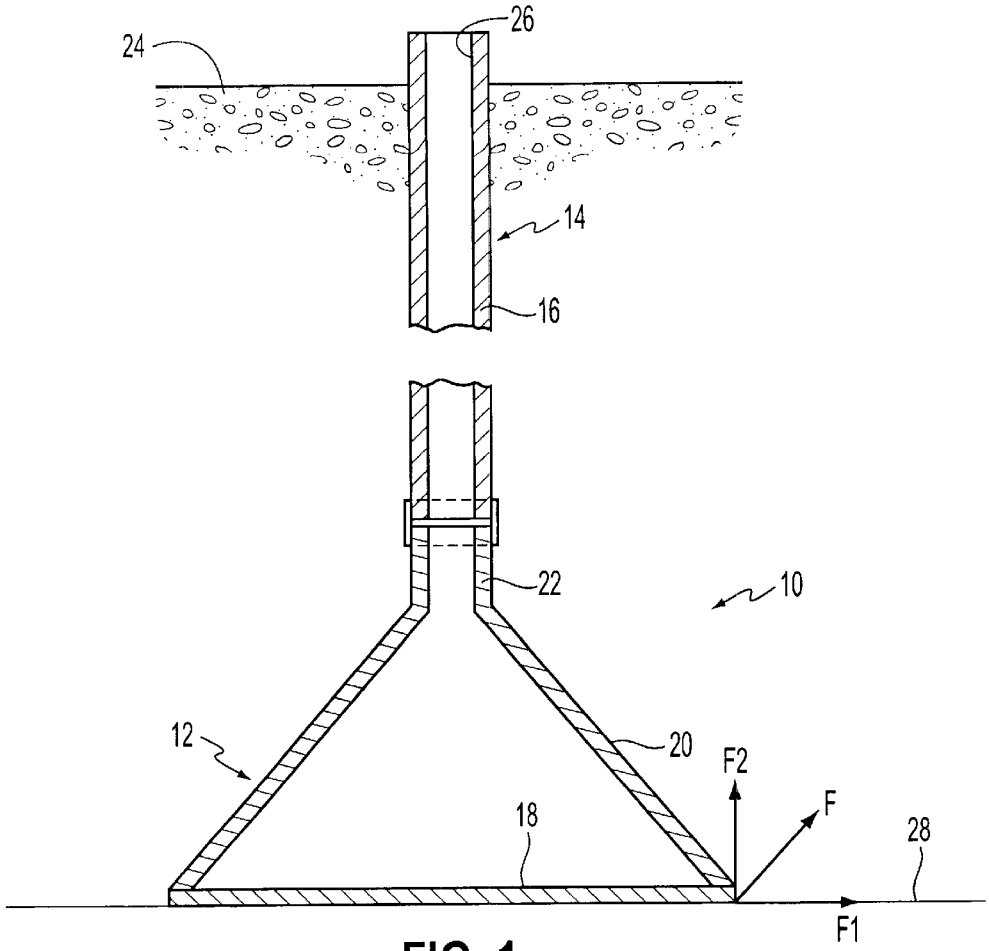
FIG. 1 is a schematic cross-sectional view of a cut-off element according to the invention.

With reference to FIG. 1, a cut-off element 10 for a concrete structure demolition device comprises a flask 12, preferably made of plastic material, designed to be joined to a support part 14 formed by a vertical tube 16. The flask 12 is in the shape of a hollow pocket with an appreciably flat closed base 18 joined to a tapered lateral casing 20. It is clear that any other revolution shape can be used to achieve the casing 20.

The base 18 can also be convex to compensate the pressure generated by the concrete when casting takes place.

The casing 20 forms an acute angle with the base 18, said angle with the base being preferably comprised between 25° and 60°. A tubular spout 22 is arranged at the top of the casing 20 to receive the bottom end of the tube 16. Fixing of the tube 16 to the casing 20 is performed by screwing or by any assembly means.

According to a first operating mode, the cut-off element 10 is inserted vertically in the fresh concrete 24 after the concrete casting operation has been performed. The length of the tube 16 is chosen such that the top end protrudes out and acts as access orifice 26 for insertion of a destruction agent, for example of the chemical or mechanical expansive type.

The depth of penetration of the cut-off element 10 into the concrete 24 determines the breaking zone 28 precisely. After the demolition agent has been inserted, an expansion effect occurs inside the plastic flask 12 after a certain time. The resulting reaction forces F are distributed perpendicularly along the wall of the tapered casing 20 and generate radial components F1 extending parallel to the base 18 and vertical components F2 perpendicular to the base 18. This results in horizontal fracturing of the concrete in the plane passing through the flat base 18 of the flask 12, which determines the cut-off zone 28. The action of the vertical components F2 causes a slight lifting movement of the concrete block when cut-off is performed.

Figure 2:
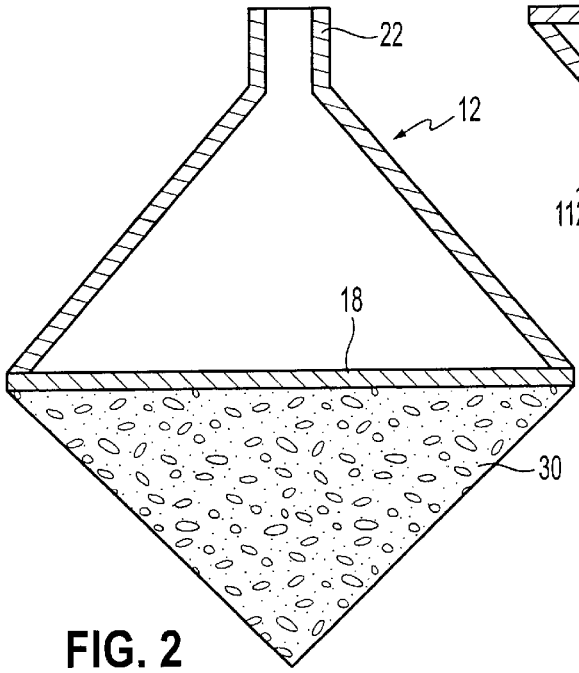
FIG. 2 represents the flask of the cut-off element of FIG. 1 associated to a guiding means facilitating penetration into the concrete.

According to FIG. 2, insertion of the cut-off element 10 into the fresh concrete is facilitated by a guiding means 30 fixed to the external face of the flat base 18. The guiding means 30 is formed by a cone, made for example of concrete, the apex whereof is facing downwards and the base whereof is in contact with the base 18.

Depending on the cross-section of the concrete structure to be cut-off, a plurality of cut-off elements 10 are placed in position in the fresh concrete. Insertion of these elements can be performed individually, or grouped on a common positioning frame 32. Insertion by means of a positioning frame enables simultaneous and quick penetration of the set of flasks 12 into the fresh concrete. The demolition agent is then inserted in the flasks 12 via the orifices 26 of the different tubes 16. After the expansion reaction of the demolition agent, horizontal fracturing of the concrete enables cut-off to be achieved by a simple vertical lifting of the fractured concrete block.

Figure 3:
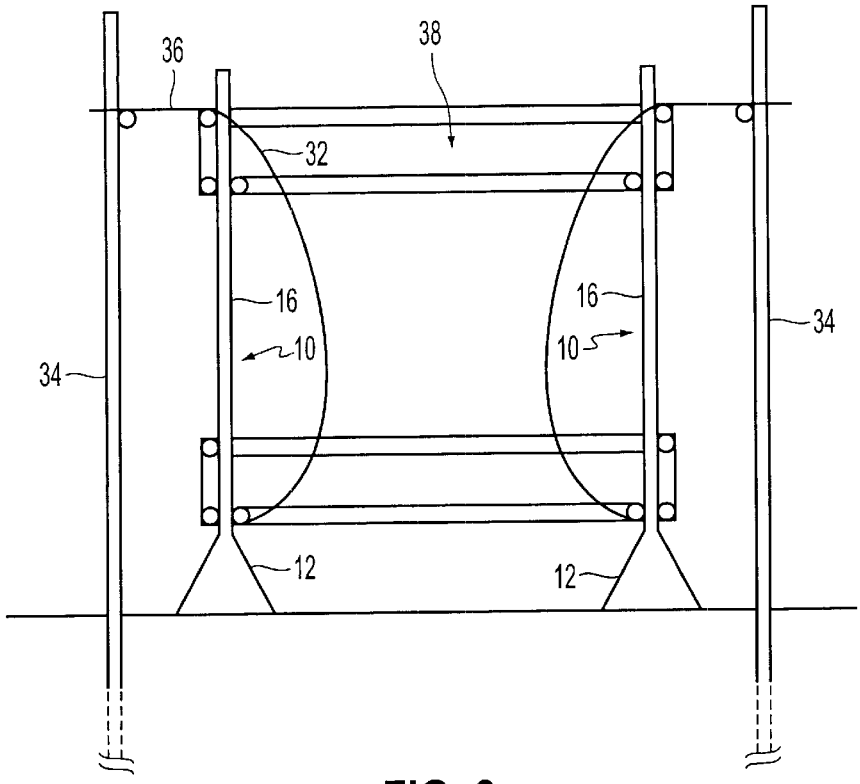
FIG. 3 shows an elevation of the positioning frame equipped with several cut-off elements for placing in position before the concrete is cast.
Figure 4:
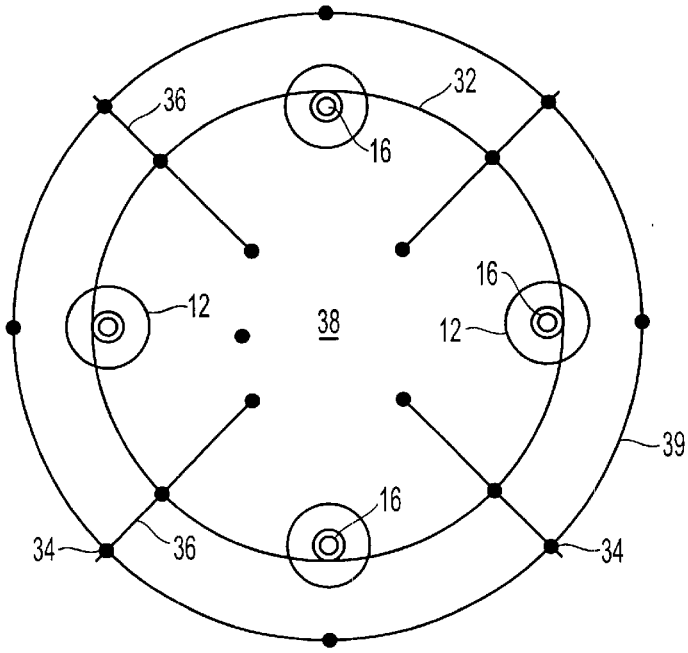
FIG. 4 is a plan view of FIG. 3.

According to the alternative embodiment of FIGS. 3 and 4, the positioning frame 32 equipped with the different cut-off elements 10 is placed in position before the concrete 24 is cast. The positioning frame 32 is fixed beforehand to the reinforcing bars 34 salient to receive the pile by spacers 36 spaced angularly between the tubes 16 and resting on a hoop 39 securedly fixed to the reinforcing bars.

The reinforcing bars 34 are formed by steel concrete bars surrounding the tubes 16 coaxially, and the spacers 36 extend radially towards the inside of the positioning frame 32 to define the internal orifice 38 for passage of the concrete casting pipe (not represented). All the bases 18 of the flasks 12 are arranged appreciably in the same horizontal plane.

In the two cases of placing the cut-off elements 10 in position after or before the concrete is cast, the expansive agent inlet tubes 16 remain integrated in the concrete block recovered after cut-off.

Figure 8:
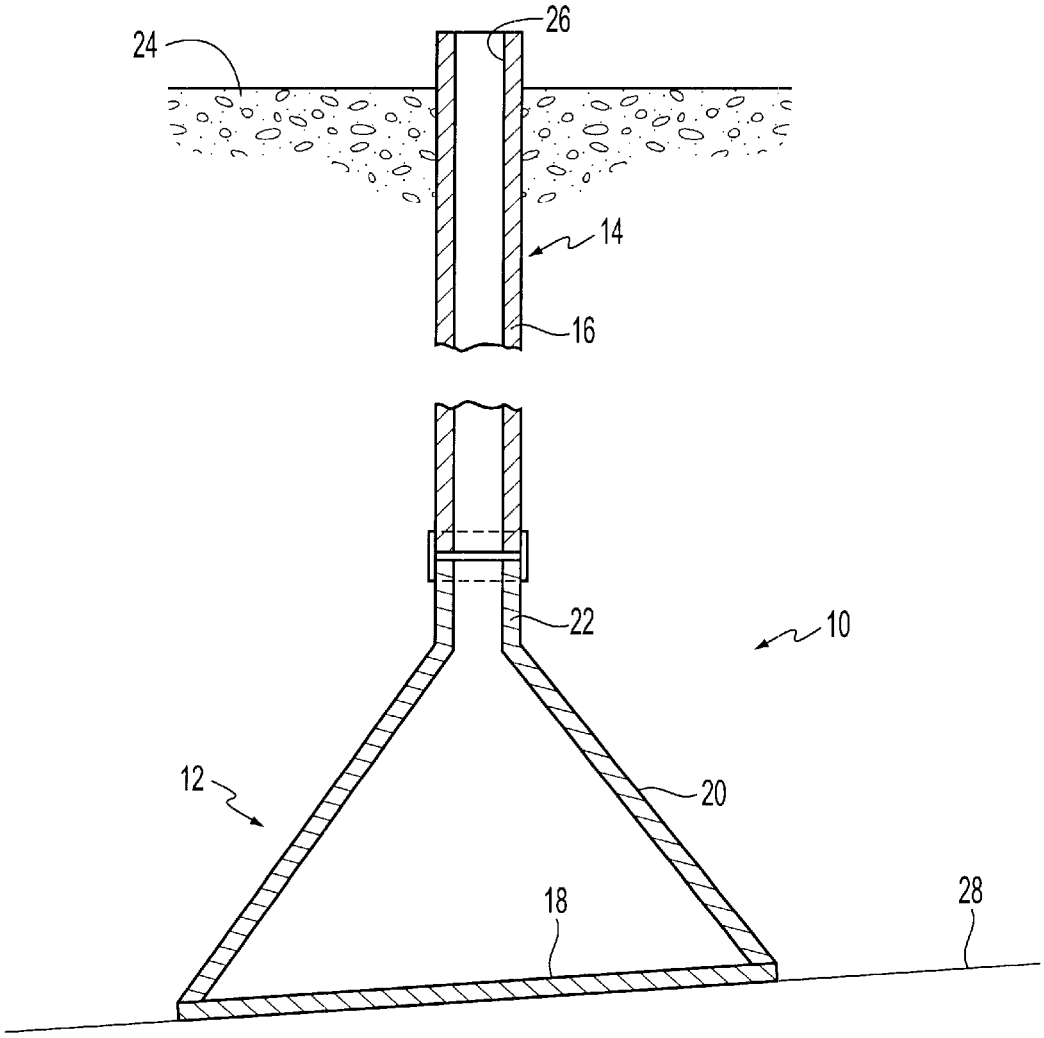
FIG. 8 is a schematic cross-sectional view of another embodiment of a cut-off element according to the invention.

The flat base 18 of the flasks 12 enables a horizontal fracture of the concrete block to be obtained according to the cut-off zone 28. It is clear that a diagonal fracture can be obtained by means of flasks having bases inclined at a preset angle corresponding to the breaking plane, as shown in figure 8.

Figure 5:
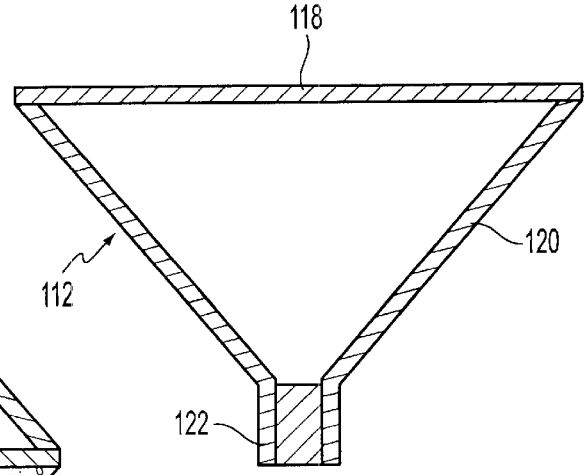
FIG. 5 is a view of a flask adapted for filling with a delayed-action reactive agent.

According to another alternative embodiment, the flasks 12 are not extended by tubes 12 but are filled directly with a delayed-action expansive agent of chemical or mechanical nature. In FIG. 5, each flask 112 comprises for this purpose a base 118 formed by a removable cover, which cover is closed after filling with the delayed-action expansive agent. In this case, the spout 122 is sealed off and the conical or tapered shape of the casing 120 is similar to that of FIG. 1.

The flasks 112 filled with the delayed-action expansive agent are either placed in position before the concrete is cast by means of a support frame or placed in position in the fresh concrete after casting by means of a recoverable rod.

The delayed-action expansion effect can have a specific time delay, preferably more than 2 days, depending on the size of the structure, the nature of the concrete and the ambient temperature.

The plastic material of the flasks 12, 112 can be replaced by any other equivalent breakable or deformable material, for example glass.

Figure 6:
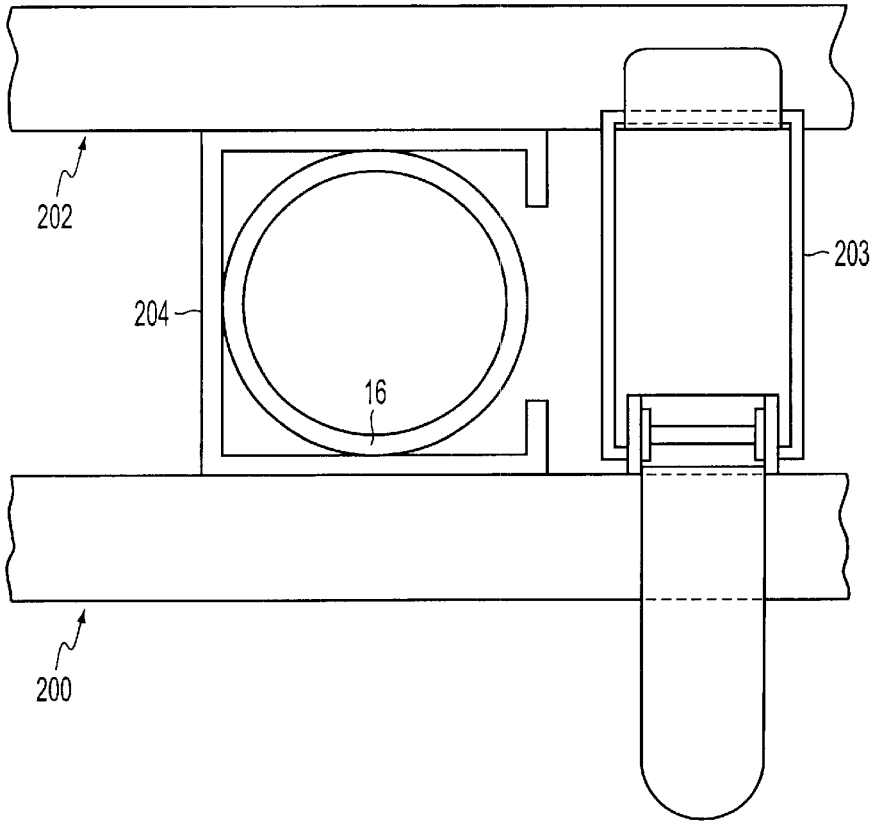
FIG. 6 shows a device for fixing a tube onto a support jig.

In FIG. 6, a device 200 for fixing a tube 16 onto a support jig 202 comprises a securing clamp 203 associated to a profiled support part 204 wherein a tube 16 is engaged. The profiled support part 204 has two flexible branches designed to move towards or away from one another depending on whether the clamp 203 is in the closed or open position.

After the concrete has been cast, the support jig 202 equipped with a plurality of tubes 16 and flasks 12 is placed on the hoop 39. The clamp 203 is actuated to the slackened position and each tube 16 is descended individually to the bottom. At the end of travel, the clamp 203 is closed to secure the tube 16.

After the cut-off operation has been performed, all the clamps 203 are opened and the support jig 202 can thus be re-used on the work-site for cutting-off another pile of the same dimension.

Figure 7:
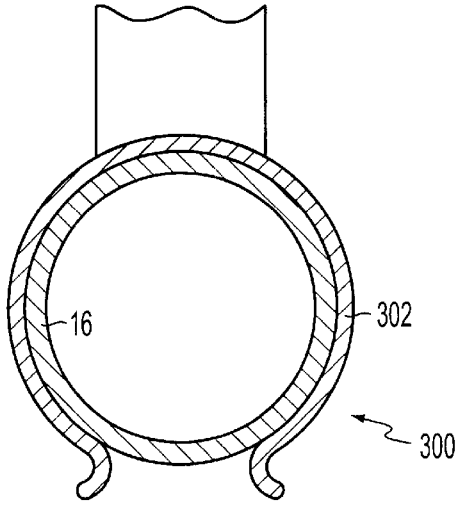
FIG. 7 represents an alternative embodiment of FIG. 6.

With reference to FIG. 7, the device 300 for fixing the tube 16 is formed by an elastically deformable clipping part 302 of appreciably circular cross-section.

What is claimed is:

1. A device for cut-off of a concrete part, comprising:

means for inserting at least one cut-off element equipped with an elemental recipient designed to receive a demolition agent of chemical or mechanical nature to cause cracking of the concrete part by expansion effect, wherein the recipient of each cut-off element is formed by a flask, made in particular of plastic material, having a closed base, and a lateral casing forming an acute angle with the base, said angle being between 25° and 60° to generate expansion forces substantially in a horizontal and upwardly direction for fracturing of the concrete part along a breaking zone defined by the base of said flask, and a lifting movement of small amplitude of the concrete part after cut-off.

2. The device for cut-off of a concrete part according to claim 1, wherein the apex of the casing is fixed to a support means for inserting the base down to the breaking zone.

3. The device for cut-off of a concrete part according to claim 2, wherein the support means of a cut-off element comprise a rigid tube joined to a tubular connecting spout arranged at the apex of the casing, said tube acting as inlet channel for insertion of the demolition agent into the flask.

4. The device for cut-off of a concrete part according to claim 3, wherein each tube is assembled on a support jig by means of a fixing device comprising a securing clamp or a clipping part.

5. The device for cut-off of a concrete part according to claim 1, wherein the base of the flask is associated with a guiding means to facilitate penetration of the cut-off element into the concrete part before being cast.

6. The device for cut-off of a concrete part according to claim 1, wherein the flat base of the flask of each cut-off element is arranged horizontally and extends perpendicularly to the direction of insertion.

7. The device for cut-off of a concrete part according to claim 1, wherein the flat base of the flask of each cut-off element is inclined or slightly convex with respect to the direction of insertion.

8. The device for cut-off of a concrete part according to claim 1, wherein insertion of each cut-off element can be performed individually, after the concrete is cast, the lateral casing of each cut-off element having a tapered shape.

9. The device for cut-off of a concrete part according to claim 8, wherein insertion of each cut-off element is grouped by a positioning frame, the positioning frame is fixed before the concrete is cast to salient reinforcing bars by means of spacers spaced angularly between the different tubes of the cut-off elements and resting on a hoop securedly affixed to the reinforcing bars.

10. The device for cut-off of a concrete part according to claim 9, wherein the spacers extend radially towards the inside of the positioning frame to confine an orifice for axial passage of the concrete casting pipe.

11. The device for cut-off of a concrete part according to claim 1, wherein the flask is filled with a delayed-action reactive agent and is placed in position before or after the concrete is cast.

12. The device for cut-off of a concrete part according to claim 1, wherein insertion of each cut-off element can be performed individually, before the concrete is cast, the lateral casing of each cut-off element having a tapered shape.

13. The device for cut-off of a concrete part according to claim 1, wherein insertion of each cut-off element can be performed in groups by means of a positioning frame, before the concrete is cast, the lateral casing of each cut-off element having a tapered shape.

14. The device for cut-off of a concrete part according to claim 1, wherein insertion of each cut-off element can be performed in groups by means of a positioning frame, after the concrete is cast, the lateral casing of each cut-off element having a tapered shape.

* * * * *